United States Patent [19]

Bean

[11] Patent Number: 4,796,048

[45] Date of Patent: Jan. 3, 1989

[54] RESILIENT INTERMEDIATE TRANSFER MEMBER AND APPARATUS FOR LIQUID INK DEVELOPMENT

[75] Inventor: Lloyd F. Bean, Rochester, N.Y.

[73] Assignee: Xerox Corporation, Stamford, Conn.

[21] Appl. No.: 124,321

[22] Filed: Nov. 23, 1987

[51] Int. Cl.[4] ..... G03G 15/14

[52] U.S. Cl. ..... 355/3 TR; 355/10

[58] Field of Search ..... 355/10, 3 TR, 14 TR; 430/126

[56] References Cited

U.S. PATENT DOCUMENTS

| | | | |
|---|---|---|---|
| 3,663,219 | 5/1972 | Takahashi | 355/10 X |
| 3,893,761 | 7/1975 | Buchan et al. | 355/3 R |
| 3,923,392 | 12/1975 | Bachan et al. | 355/3 R |
| 4,007,041 | 2/1977 | Chow | 430/126 X |
| 4,232,961 | 11/1980 | Masuda | 355/14 R |
| 4,420,244 | 12/1983 | Landa | 355/3 TR |
| 4,514,078 | 4/1985 | Beduchaud et al. | 355/3 BE |
| 4,518,976 | 5/1985 | Tarami et al. | 346/153.1 |
| 4,542,978 | 9/1985 | Tarumi et al. | 355/3 TR |
| 4,556,309 | 12/1985 | Weber et al. | 355/3 TR |
| 4,559,509 | 12/1985 | Mayer | 355/3 TR |
| 4,560,268 | 12/1985 | Nishimura | 355/3 R |
| 4,684,238 | 8/1987 | Till et al. | 355/10 |
| 4,690,539 | 9/1987 | Radalski et al. | 355/3 TR |
| 4,708,460 | 11/1987 | Langdon | 355/3 TR X |

FOREIGN PATENT DOCUMENTS

| | | | |
|---|---|---|---|
| 58-58572 | 4/1983 | Japan | 355/10 |

*Primary Examiner*—A. T. Grimley
*Assistant Examiner*—J. Pendegrass
*Attorney, Agent, or Firm*—William A. Henry, II

[57] ABSTRACT

An apparatus in which a plurality of liquid images are transferred from a photoconductive member to a copy sheet. The liquid images, which include a liquid carrier having toner particles dispersed therein, are attached from the photoconductive member to an intermediate belt by a biased transfer roll. At the same time, the biased transfer roll squeegees the liquid carrier from the intermediate belt and the toner particles are compacted thereon in image configuration. Thereafter, the toner particles are transferred from the intermediate belt to the copy sheet in image configuration with the use of another biased transfer roll. A vacuum source and an infrared heater is employed to remove residual solvent from the intermediate member left after photoconductor to intermediate member transfer takes place.

13 Claims, 3 Drawing Sheets

RESILIENT INTERMEDIATE TRANSFER MEMBER AND APPARATUS FOR LIQUID INK DEVELOPMENT

This invention relates generally to an electrostatographic printing machine, and more particularly concerns an apparatus for transferring a liquid image having at least a liquid carrier with toner particles from a photocondutive member to a copy sheet In electrophotographic printing, a charged photoconductive member is exposed to a light image of an original document. The irradiated area of the photoconductive surface is charged to record an electrostatic latent image thereon corresponding to the informational area contained within the original document. Generally, the electrostatic latent image is developed by bringing a developer mixture into contact therewith. A dry developer mixture usually comnprises carrier granules having toner particles adhering triboelectrically thereto. Toner particles are attracted from the carrier granules to the latent image forming a toner powder image thereon. Alternatively, a liquid developer material may be employed. The liquid developer material includes a liquid carrier having toner particles dispersed therein. The liquid developer material is advanced into contact with the electrostatic latent image and that toner particles are deposited thereon in image configuration. After the toner particles have been deposited on the photoconductive surface, in image configuration, it is transferred to a copy sheet. Generally, when a liquid developer material is employed, the copy sheet is wet with both the toner particles and the liquid carrier. Thus, it becomes necessary to remove the liquid carrier from the copy sheet. This may be accomplished by drying the copy sheet prior to fusing the toner particles thereto or relying upon the fusing process to permanently fuse the toner particles to the copy sheet as well as vaporizing the liquid carrier adhering thereto. Clearly, it is desirable to refrain from transferring any liquid carrier to the copy sheet. Thus, it is advantageous to transfer the developed image to an intermediate web or belt and remove as much of the liquid as possible during transfer and prior to the transfer of the toner particles to the copy sheet.

In prior art systems, Masuda in U.S. Pat. No. 4,232,961 shows the use of an image transfer contact roller which urges the image transfer belt against the photoreceptor drum. The contact roller is comprised of two rollers, along with a charger interposed between the rolls.

Landa describes in U.S. Pat. No. 4,420,244 the use of a reverse roller which reduces the excess liquid on the developed image before transfer and also acts as a metering device with a biased potential applied thereon.

Beduchaud et al. discloses the use of a potential difference between an auxiliary roller and a pressure roller to facilitate image transfer in U.S. Pat. No. 4,514,078.

In U.S. Pat. No. 4,556,309 Weber et al. describes an intermediate transfer medium which brought into intimate contact with an electrophotographic member to facilitate the transfer of toner pigments by the use of a high intensity electrical field.

Mayer, in U.S. Pat. No. 4,559,509, discloses a double potential bias system which improves the transferring capability between a transfer roller and a photoconductive drum.

U.S. Pat. No. 4,560,268 to Nishimura discloses a restart roller and a toner recovery roller. The restart roller has a discharge lamp or charger which attenuates the holding force of the electrostatic charges which define the electrostatic image on the photoconductive drum. This allows the smooth transfer of the toner image to the transfer sheet.

In U.S. Pat. No. 4,684,238, Till et al. disclose an apparatus for transferring a liquid image from a photoconductive member to an intermediate member and subsequently to a copy sheet.

The above mentioned patents are incorporated herein by reference to the extent necessary to practice the present invention.

Accordingly, an apparatus for transferring a liquid image having at least a liquid carrier with toner particles dispersed therein from a member to a copy sheets disclosed as including an intermediate member positioned to have at least a portion thereof contacting the member in a transfer zone, first biased roll transfer means positioned adjacent a nip formed between the member and the intermediate member for attracting the liquid image from the member to the intermediate member and for roller squeezing the member and the intermediate member substantially free of carrier fluid and means for transferring the toner particles from the intermediate member to the copy sheet in image configuration by the control logic.

The above-mentioned features and others of the invention together with the manner of obtaining them will best be understood by making reference to the following specification in conjunction with the accompanying drawings, wherein.

Figure 3:
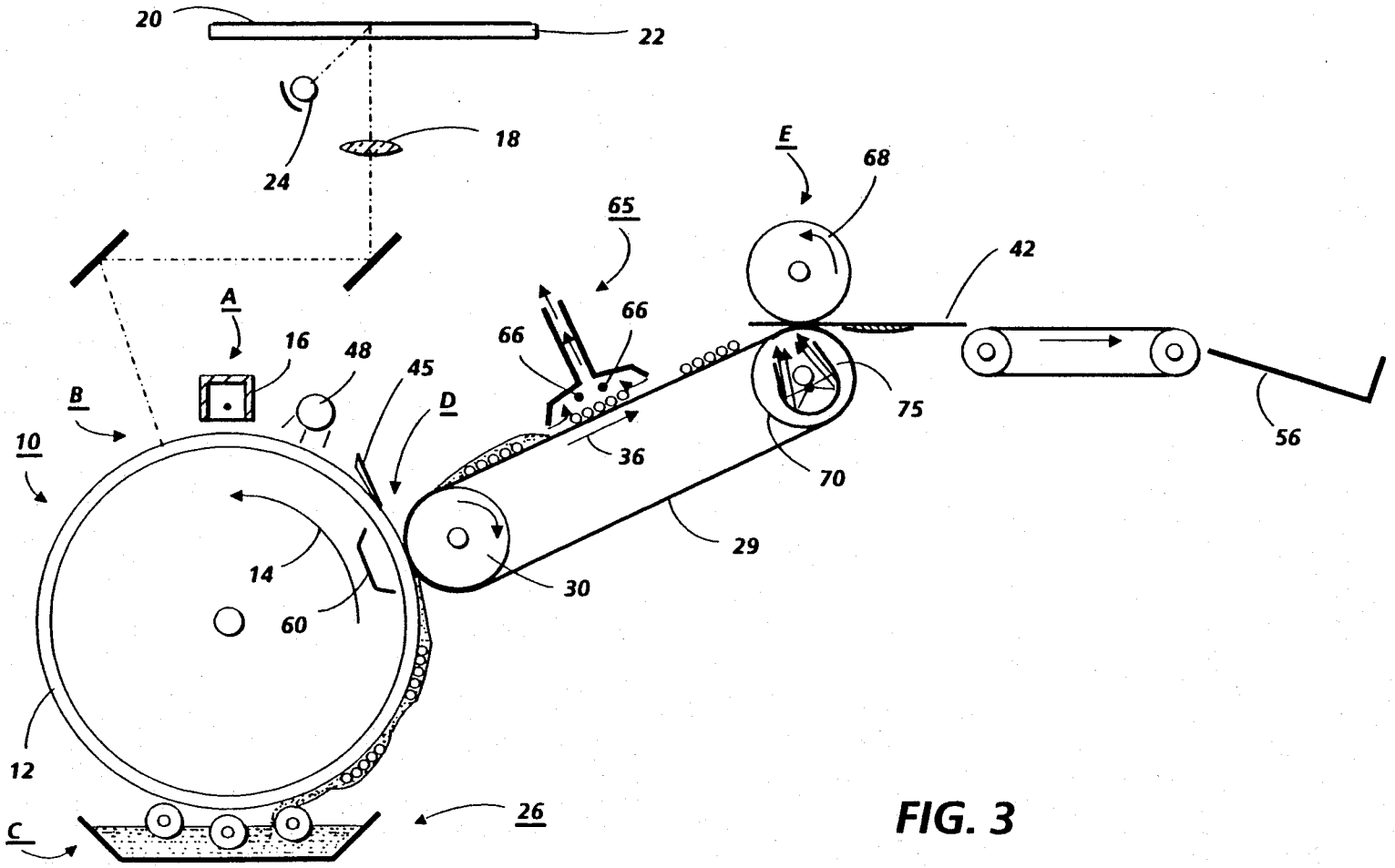

FIG. 3 is yet another alternative embodiment of the present invention that includes an IR heater at the image to paper transfer point While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
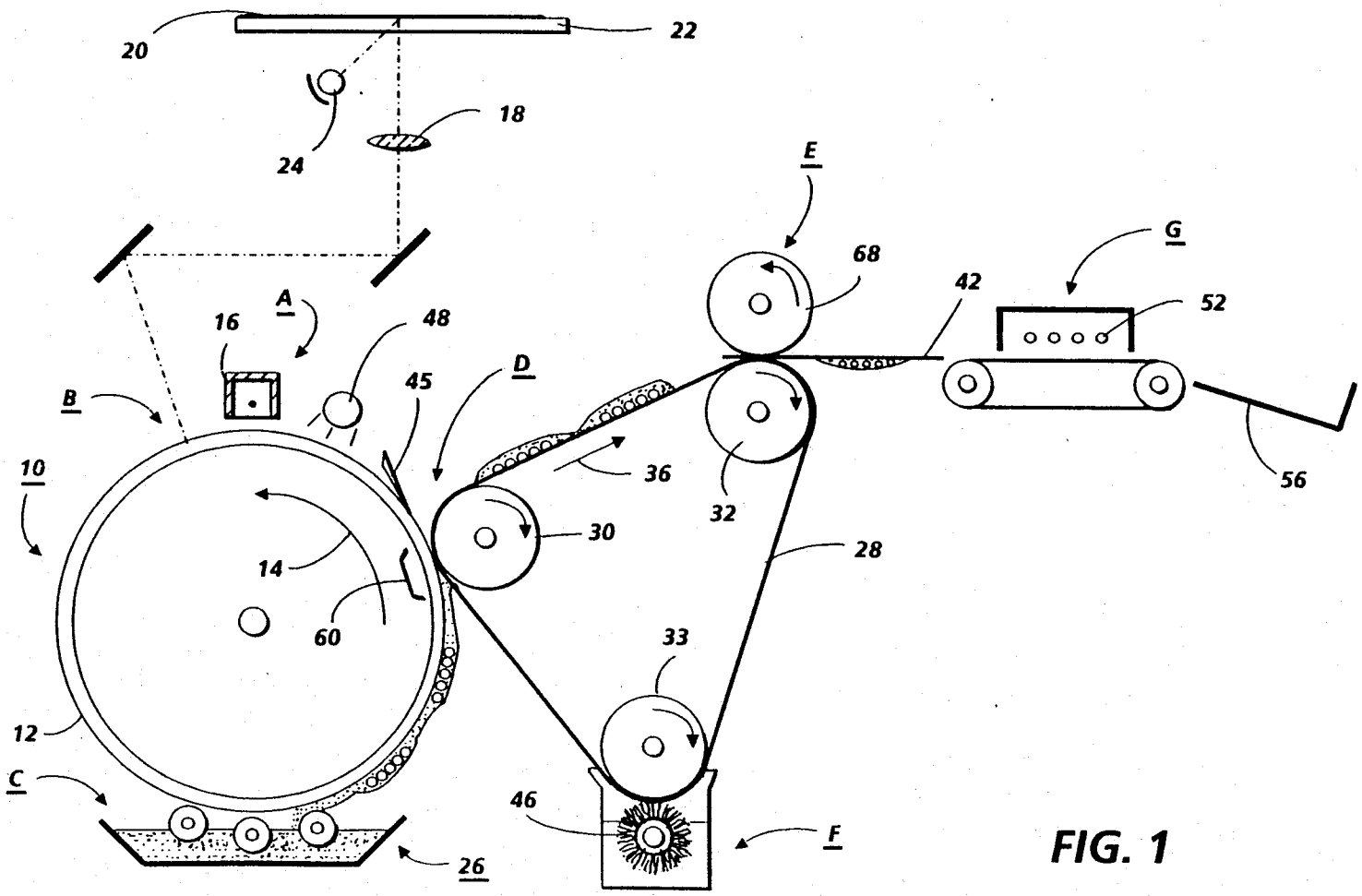
FIG. 1 is an enlarged schematic elevational view showing an electrophotographic copier employing the features of the present invention.

For a general understanding of the features of the present invention, reference is had to the drawings. In the drawings, like reference numerals have been used throughout to designate identical elements. FIG. 1 schematically depicts the various components of an illustrative electrophotographic copying machine incorporating the liquid ink transfer apparatus of the present invention therein.

Inasmuch as the art of electrophotographic copying is well known, the various processing stations employed in the FIG. 1 copying machine will be shown hereinafter schematically and their operation described briefly with reference thereto.

As shown in FIG. 1, the illustrative electrophotographic printing machine employs a drum 10 having a photoconductive surface 12 thereon that is not chemically or physically attacked by image developer that includes straight chain hydrocarbons as carrier fluid. Preferably, the photoconductive surface 12 is made from a selenium alloy. A series of processing stations are positioned about drum 10 such that as drum 10 rotates in the direction of arrow 14, it passes sequentially therethrough. Drum 10 is driven at a predetermined speed relative to the other machine operating mechanisms by a drive motor. Timing detectors sense the rotation of drum 10 and communicate with the machine logic to synchronize the various operations thereon with the rotation of drum 10. In this manner, the proper sequence of events is produced at the respective processing stations.

Drum 10 initially rotates the photoconductive surface 12 through charging station A. At charging station A, a corona generating device, indicated generally by the reference numeral 16 sprays ions onto photoconductive surface 12 producing a relatively high, substantially uniform charge thereon.

Next, the charged photoconductive surface is rotated on drum 10 to exposure station B. At exposure station B, a light image of an original document is projected onto the charged portion of the photoconductive surface 12. Exposure station B is a moving line system, generally designated by the reference numeral 18. An original document 20 is positioned face down upon a generally planar, substantially transparent platen 22. Lamps 24 area adapted to move in a timed relationship with line 18 to scan successive incremental areas of original document 20. In this manner, a flowing light image of original document 20 is projected onto the charged portion of photoconductive surface 12. This selectively dissipates the chart on photoconductive surface 12 to record an electrostatic latent image thereon corresponding to the informational areas in original document 20. While a light lens system has heretofore been described, one skilled in the art will appreciate that other techniques, such as a modulated laser beam may be employed to selectively discharge the charged portion of the photocondutive surface to record the electrostatic latent image thereon.

After exposure, drum 10 rotates the electrostatic latent image recorded on photoconductive surface 12 to development station C. Development station C includes a developer unit, generally indicated by the reference numeral 26. Developer unit 26 includes rollers adapted to advance the liquid developer material into contact with the electrostatic latent image recorded on photoconductive surface 12. By way of example, the liquid developer material comprises an insulating carrier material made from an aliphatic hydrocarbon, largely decane, which is manufactured by the Exxon Corporation, under the trademark Isopar having toner particles dispersed therein. Preferably, the toner particles are made predominantly from pigmented material such as a suitable resin. A suitable liquid developer material is described in U.S. Pat. No. 4,582,774 issued to Landa in 1986, the relevant portions thereof being hereby incorporated herein by reference. The developed electrostatic latent image is transported on drum 10 to transfer station D.

At transfer station D, the developed liquid image is electrostatically transferred to an intermediate member or a belt indicated generally by the reference numeral 28. Belt 28 is entrained about spaced biased transfer rollers 30 and 32, respectively and a drive roller 33. Belt 28 moves in the direction of arrow 36. Further details with reference to the transfer system will be described hereinafter.

With continued reference to FIG. 1, compacted toner particles that have been transferred to the intermediate member are advanced to an impression area at station E. At station E, copy sheet 42 is advanced, in synchronism, with the toner particle image on belt 28. Invariably, some residual liquid carrier and toner particles remain adhering to photoconductive surface 12 of drum 10 after the transfer to belt 28. These residual particles are removed from photoconductive surface 12 by a flexible blade 45. Thereafter, lamp 48 is energized to discharge any residual charge on photoconductive surface 12 preparatory for the next successive imaging cycle. Residual particles and liquid left on the intermediate member after transfer are removed at cleaning station F. Cleaning station F includes a brush 46 with flexible bristles attached thereto. The free end portions of the bristles are in contact with the intermediate member to remove any material adhering thereto.

After the toner particles are transferred to copy sheet 42, the copy sheet advances on a conventional conveyor through fusing station G and into catch tray 56. Fusing station G includes a radiant heater 52 which radiates sufficient energy to permanently fuse the toner particles to the copy sheet 42 in image configuration. When copy sheet 42 is located in catch tray 56, it may readily be removed therefrom by the machine operator.

The foregoing describes generally the operation of the electrophotographic printing machine including the transfer apparatus and methods of the present invention therein. The detailed structure of the transfer methods and apparatus will hereinafter be described with beginning reference to FIG. 1, where intermediate belt member 28 is shown contacting drum 10 in transfer zone 60. Intermediate belt member 28 has a smooth (non-solvent retaining) surface, is non-absorbent with reference to carrier fluid, has a low surface energy which makes it adhesive, with reference to toner particles, is resistant and optionally is either infrared transmitting or infrared reflecting. The liquid developed image is electrostatically transferred to intermediate member 28 using a biased transfer roller 30. Also, the pressure between the intermediate 28 and image bearing drum 10 is such that (a) non-image areas of the intermediate and image bearing member are squeegeed free of carrier liquid and (b) the intermediate is deformed by the toner in image areas allowing toner particles and carrier fluid to pass through the nip region formed between the photoconductor and intermediate member. The toner image is thereaften conveyed to station E where it is transferred to copy sheet 42 by means of biased transfer roll 32. It should be understood that the distance between the intermediate and the copy sheet 42 is such that the fluid associated with the image areas on the intermediate contact the surface of the copy sheet. This process greatly reduces the solvent transferred to the copy sheet because (a) no solvent is absorbed by the copy sheet in non-image areas which is 95% of the surface of the copy sheet of most typed originals (i.e., a factor of twenty reduction) and (b) the solvent image areas are metered to the amount necessary for electrostatic transfer (i.e., no excess fluid).

Figure 2:
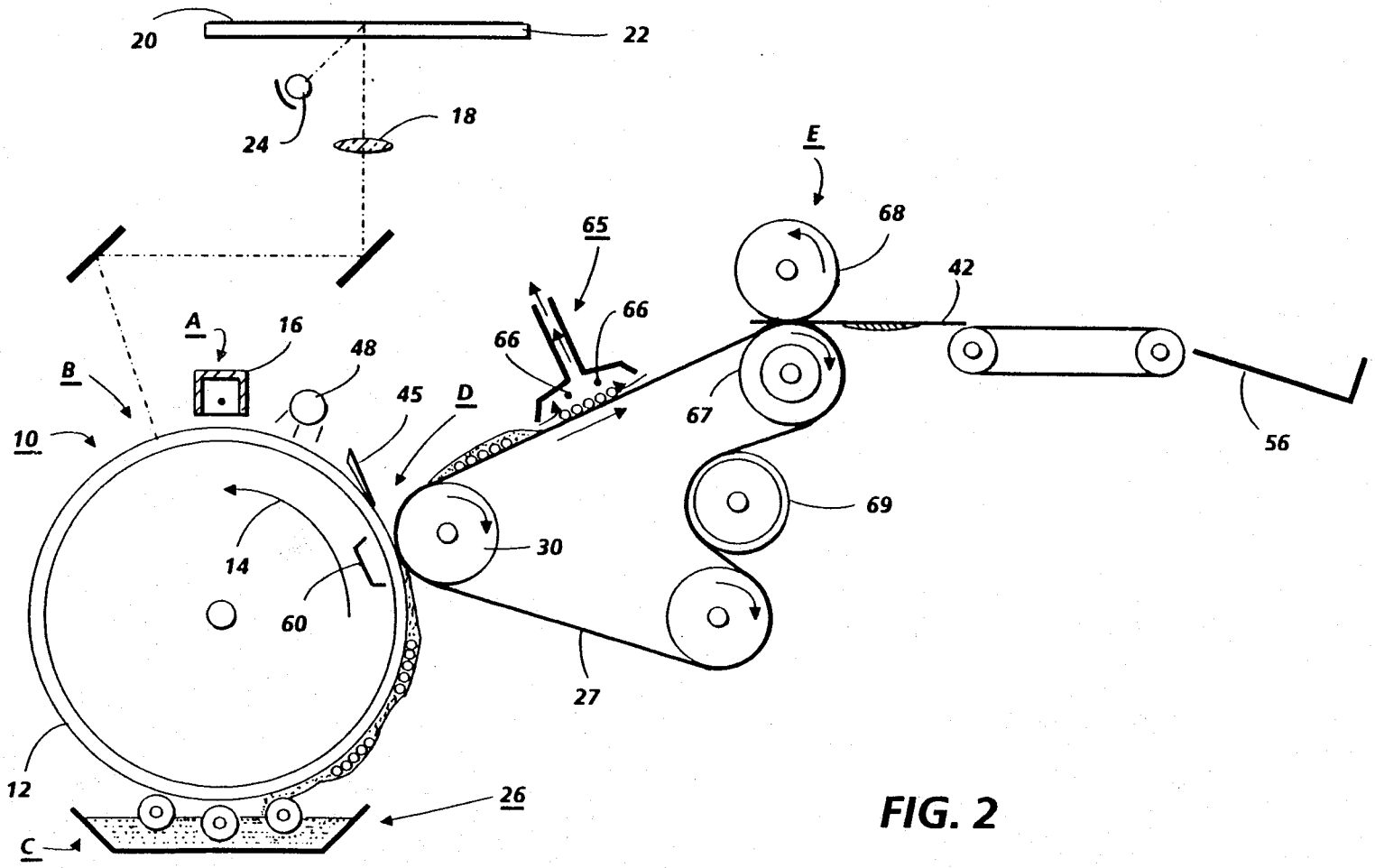
FIG. 2 shows an enlarged alternative embodiment of the present invention.

Another embodiment of the present invention is shown in FIG. 2 where toner images on an infrared reflecting adhesive intermediate member 27 are shown after transfer being transported to a solvent recovery device 65 that comprises a gentle vacuum to solvent trap/recovery that draws solvent away from intermediate member 27. Infrared heater members 66 are positioned within a mouth portion of the trap/recovery device. The process steps are similar to those described for FIG. 1 in that background fluid is removed during the electrostatic transfer step to the intermediate. The process differs in that the fluid associated with the image is removed by infrared heating (selective) and the solvent vapor collected prior to the image being transferred to copy sheet 42. At station E, a heated fuser roll 67 is positioned adjacent impression roll 68 and adapted to fix the image on the intermediate member onto copy sheet 42 at the nip formed between the two rolls for transport to catch tray 56. The intermediate member 27 is supported on biased transfer roll 30, fuser roll 67 and an idler roll and is tensioned by an optional heat dissipation roll 69.

In another alternative embodiment of the present invention shown is FIG. 3, an apparatus is shown that employs process steps similar to those employed in FIG. 1 in that background fluid is removed from intermediate 29 during the electrostatic transfer step to the intermediate. The process differs in that the fluid associated with the image is removed by infrared heating of the intermediate belt and the solvent collected prior to transfer of an image to a copy sheet. The intermediate 29 in FIG. 3 is infrared transparent and is mounted over a focused infrared heater 75 positioned inside an infrared transparent roll 70. The infrared heater is focused at a pre-nip area or region immediately before a nip formed between impression roll 68 and quartz or Pyrex roll 70. Transfer to copy sheet 42 is accomplished by infrared heating of the image on intermediate member 29 such that toner resin is melted and the image is thermally offset to the copy sheet from the adhesive intermediate member when the toner resin is a solid and separation of the copy sheet and intermediate member occurs.

It should now be understood that both processes and apparatuses have been disclosed that electrostatically transfer liquid images to a non-absorbing, resilient intermediates prior to transfer to paper to reduce solvent pick-up by the copy. The intermediates are pressed against a photoreceptor to mechanically squeesee solvent predominantly from the non-image background areas. The intermediats conform over image areas analogous to the action of a soft roll fuser surface. Bias transfer rolls are shown for applying the transfer field. The electrical requirements are similar to those for dry xerography biased roll transfer to avoid distrubing the images. Solvent can be further removed from the intermediates by heating them prior to transferring the images to paper. These systems have advantages over the prior art in that since the solvent level at the paper transfer station has been reduced, high pressure and long transfer nips may be used for high transfer efficiency.

What is claimed is:

1. An apparatus for transferring a liquid image having at least liquid carrier with toner particles dispersed therein from a member to a copy sheet, including:

an intermediate member positioned to have at least a portion thereof contacting the member in a transfer zone;

first biased roll transfer means positioned adjacent to a nip formed between the member and said intermediate member for attracting the liquid image from the member to said intermediate member and for roller squeezing the member and said intermediate member with a pressure such that (a) non-imaged areas of the member and said intermediate member are squeezed free of carrier fluid and (b) said intermediate member is deformed by the toner in image areas allowing toner particles and carrier fluid to pass through said nip; and means for transferring the toner particles from said intermediate member to the copy sheet in image configuration.

2. The apparatus of claim 1, wherein said means for transferring the toner particles from said intermediate member to the copy sheet is a biased transfer roll.

3. The apparatus of claim 1, including brush means for cleaning exxess toner particles from said intermediate member.

4. The apparatus of claim 1, wherein said means for transferring the toner particles from said intermediate member to the copy sheet is a fuser roll.

5. The apparatus of claim 1, wherein said means for transferring the toner particles from said intermediate member to the copy sheet is an infrared heater.

6. The apparatus of claim 1, including means for heating said intermediate member prior to transfer of the image from said intermediate member to the copy sheet.

7. The apparatus of claim 6, wherein said means for heating said intermediate member comprises infrared heaters.

8. The apparatus of claim 7, wherein said intermediate member is infrared reflective.

9. The apparatus of claim 7, wherein said intermediate member is infrared transparent.

10. The apparatus of claim 7, wherein said infrared heater is positioned within a transparent roll member that supports said intermediate member adjacent an impression roll to form a nip therebetween for passage of the copy sheet.

11. The apparatus of claim 10, wherein said infrared heater is is focussed at a region immediately preceeding said nip formed between said imppression roll and said transparent roll.

12. The apparatus of claim 1, including means form removing solvent therefrom and heating said intermediate member prior to transfer of the image from said intermediate member to the copy sheet.

13. The apparatus of claim 12, wherein said means for removing solvent from said intermedaite includes a vacuum means.

* * * * *